US005612502A

United States Patent [19]

Ura

[11] Patent Number: 5,612,502

[45] Date of Patent: Mar. 18, 1997

[54] KEYBOARD MUSICAL INSTRUMENT ESTIMATING HAMMER IMPACT AND TIMING FOR TONE-GENERATION FROM ONE OF HAMMER MOTION AND KEY MOTION

[75] Inventor: Tomoyuki Ura, Shizuoka, Japan

[73] Assignee: Yamaha Corporation, Japan

[21] Appl. No.: 509,812

[22] Filed: Aug. 1, 1995

[30] Foreign Application Priority Data

Aug. 1, 1994 [JP] Japan ..... 6-199048
Apr. 19, 1995 [JP] Japan ..... 7-094064

[51] Int. Cl.[6] ..... G10C 3/12; G10C 5/00; G10D 15/00; G10H 1/34

[52] U.S. Cl. ..... 84/687; 84/719; 84/720; 84/21; 84/171

[58] Field of Search ..... 84/615, 626, 633, 84/658, 665, 687–690, 711, 719, 720, 2, 3, 19–22, 171, 236–255, 423 R, 433, DIG. 7

[56] References Cited

U.S. PATENT DOCUMENTS 4,307,648 12/1981 Stahnke ..... 84/462
4,913,026 4/1990 Kaneko et al. ..... 84/21
5,164,532 11/1992 Ishii et al. ..... 84/639

FOREIGN PATENT DOCUMENTS 0206284 12/1986 European Pat. Off. .
0639824A2 2/1995 European Pat. Off. .
2620255 3/1989 France .

*Primary Examiner*—Stanley J. Witkowski
*Attorney, Agent, or Firm*—Graham & James LLP

[57] ABSTRACT

A keyboard musical instrument includes an acoustic piano for generating acoustic sounds, an electronic system for generating electronic sounds and a silent system for selecting one of the acoustic sounds and the electronic sounds, and the electronic system is equipped with key sensors and hammer sensors so as to determine a loudness of the electronic sound and a timing for a tone-generation from a key position signal or a hammer position signal depending upon a fingering on a keyboard.

8 Claims, 11 Drawing Sheets

| KEY CODE | REG. A | REG. B | REG. C | | REG. L | REG. M | REG. N |
|---|---|---|---|---|---|---|---|
| KC 1 | | | | | | | |
| KC 2 | | | | | | | |
| ⋮ | | | | | | | |
| KC 88 | | | | | | | |

| WORKING REGISTERS | SUB-MODE | SENSOR TO BE USED | TABLE TO BE USED |
|---|---|---|---|
| F.H.J.K = 0 | | | |
| C ≧ PREDETERMINED VALUE (127) | A | HAMMER SENSOR | – |
| C < PREDETERMINED VALUE (127) | | | |
| 38 ≦ C < 127 ---------- | B | HAMMER SENSOR KEY SENSOR | TBL1 |
| C < 38 | | | |
| D ≦ 150 ---------- | C | ditto | TBL1 |
| D > 150 ---------- | D | ditto | TBL2 |
| F = 1 ---------- | E | ditto | TBL2 |
| H = 1 ---------- | F | KEY SENSOR | TBL2 |
| J = 1 ---------- | G | ditto | TBL2 |
| K = 1 ---------- | H | ditto | TBL2 |

Fig. 9

KEYBOARD MUSICAL INSTRUMENT ESTIMATING HAMMER IMPACT AND TIMING FOR TONE-GENERATION FROM ONE OF HAMMER MOTION AND KEY MOTION

FIELD OF THE INVENTION

This invention relates to a keyboard musical instrument and, more particularly, to a keyboard musical instrument including an acoustic piano and an electronic sound generating system.

DESCRIPTION OF THE RELATED ART

A keyboard musical instrument playable through acoustic/electronic sounds has been sold in the market. The keyboard musical instrument is equipped with a silent system which prevents strings from hammers, and an electronic sound system generates electronic sounds on the basis of fingering on the keyboard. Namely, sensors are monitoring the fingering during the performance, and a tone generator generates an audio signal indicative of notes, loudness and tone generating timings. The audio signal is supplied to a headphone, and the player can confirm the performance through the electronic sounds.

The monitor on the fingering is broken down into two ways. The first monitoring system includes key sensors respectively provided for the black and white keys of the keyboard, and each of the key sensors detects the associated key moved between a rest position and an end position at more than one point. The detecting points are spaced apart by a predetermined distance, and reports the detections at the points to a data processor forming a part of the tone generator. The data processor calculates a key velocity, and estimates the intensity of the impact and the impact timing.

On the other hand, the second monitoring system includes a plurality of hammer sensors respectively associated with the rotatable hammers. Each of the hammer sensors also has more than one detecting point, and generates a binary data code indicative of the current hammer position. When the hammer is driven for rotation toward an associated string, the hammer sensor detects the hammer at the detecting points during the free rotation, and the data processor estimates the intensity of the impact and the impact timing. After a release of the depressed key, the hammer returns to the home position, and the hammer sensor detects the hammer again. The data processor estimates a timing for sound termination, and the tone generator terminates the audio signal at the estimated timing.

However, the first monitoring system encounters a problem in fidelity of the electronic sounds. This is because of the fact that the key motion represented by the key velocity does not correspond to the hammer motion at all times.

For example, if a player mincingly repeats a key across the detecting points, the acoustic tones are not loud due to the short stroke. However, the key velocity is so large that tone generator tailors the audio signal representing a loud sound. The electronic sound is too loud, and the player wonders the loud electronic sound.

Although the second monitoring system enhances the fidelity, the following problems are encountered in the second monitoring system. The hammer usually turns over an arc longer than that of the associated key, and the hammer sensor can monitor the hammer passing through a smaller part of the arc than the key sensor. In general, if the hammer sensor is closer to the string, the estimated hammer velocity reflects the hammer intensity more exactly. For this reason, the hammer sensors are provided around a hammer stopper where the hammers rebound. In an actual performance, the player sometimes depresses a key immediately after a release at the end position, and the hammer is directed toward the hammer stopper before reaching the rest position. The hammer may pass through one of the detecting points closest to the hammer stopper after the rebound. However, the hammer is missing at the other detecting point, and the data processor can not estimate the intensity and the sound generating timing for the second impact. Thus, the first problem of the second monitoring system is missing hammer position data.

The second problem is the sensor position spaced from the optimum position. As described hereinbefore, the optimum sensor position is around the strings. However, the hammer sensors can not advance beyond the hammer stopper.

The third problem is a misapprehention of the data processor. The hammer sensors tend to chatter due to the impact of the hammer against the hammer stopper. The hammer sensor hardly detects an exact hammer position under the chattering, and misapprehention takes place. In order to avoid the misapprehention, the data processor is expected to execute a complicated processing for exceptions.

SUMMARY OF THE INVENTION

It is therefore an important object of the present invention to provide a keyboard musical instrument which exactly estimates an impact of a hammer against a string.

To accomplish the object, the present invention proposes to estimate an intensity of impact and a timing for a tone generation from either key or hammer sensor depending upon a fingering on a depressed key.

In accordance with one aspect of the present invention, there is provided a keyboard musical instrument comprising: an acoustic piano including a plurality of keys responsive to fingerings of a player so as to turn around a stationary board member, a plurality of key action mechanisms functionally connected to the plurality of keys, a plurality of strings corresponding to the plurality of keys, respectively, and a plurality of hammer assemblies respectively driven for rotations by the plurality of key action mechanisms, and respectively striking the plurality of strings through the rotations for generating acoustic sounds; and an electronic system including a plurality of key sensors respectively associated with the plurality of keys for monitoring key motions, and producing key position signals each indicative of an actual key position of the associated key, a plurality of hammer sensors respectively associated with the plurality of hammer assembly for monitoring hammer motions, and producing hammer position signals each indicative of an actual hammer position of the associated hammer assembly, a first means operative estimate a first intensity of impact of the hammer assembly on the associated string and a first timing for the impact from each key motion, a second means operative to estimate a second intensity of impact of the hammer assembly on the associated string and a second timing for the impact from each hammer motion, a third means for analyzing each of the fingerings on the plurality of keys, and a fourth means for selecting one of the first intensity of impact and the second intensity of impact and one of the first timing and the second timing for generating an electric signal.

In accordance with another aspect of the present invention, there is provided a keyboard musical instrument having at least an acoustic sound mode and an electronic sound mode, comprising: an acoustic piano including a plurality of keys responsive to fingerings of a player so as to turn around a stationary board member, a plurality of key action mechanisms functionally connected to the plurality of keys, a plurality of strings corresponding to the plurality of keys, respectively, and a plurality of hammer assemblies respectively driven for rotations by the plurality of key action mechanisms, and respectively striking the plurality of strings through the rotations for generating acoustic sounds; an electronic system including a plurality of key sensors respectively associated with the plurality of keys for monitoring key motions, and producing key position signals each indicative of an actual key position of the associated key, a plurality of hammer sensors respectively associated with the plurality of hammer assembly for monitoring hammer motions, and producing hammer position signals each indicative of an actual hammer position of the associated hammer assembly, a first means operative estimate a first intensity of impact of the hammer assembly on the associated string and a first timing for the impact from each key motion, a second means operative to estimate a second intensity of impact of the hammer assembly on the associated string and a second timing for the impact from each hammer motion, a third means for analyzing each of the fingerings on the plurality of keys, and a fourth means for selecting one of the first intensity of impact and the second intensity of impact and one of the first timing and the second timing for generating electronic sounds; and a silent system changed between a free position in the acoustic sound mode and a blocking position in the electronic sound mode, the silent system in the free position allowing the plurality of hammer assemblies to strike the associated strings for playing a music through the acoustic sounds, the silent system in the blocking position causing the plurality of hammer assembly to rebound before an impact on the strings, thereby allowing the electric system to play a music through the electronic sounds.

BRIEF DESCRIPTION OF THE DRAWINGS

The features and advantages of the keyboard musical instrument according to the present invention will be more clearly understood from the following description taken in conjunction with the accompanying drawings in which:

FIG. 9 is a view showing a relation between the values of the working registers and sub-modes;

DESCRIPTION OF THE PREFERRED EMBODIMENT

Structure of Keyboard Musical Instrument

Figure 1:
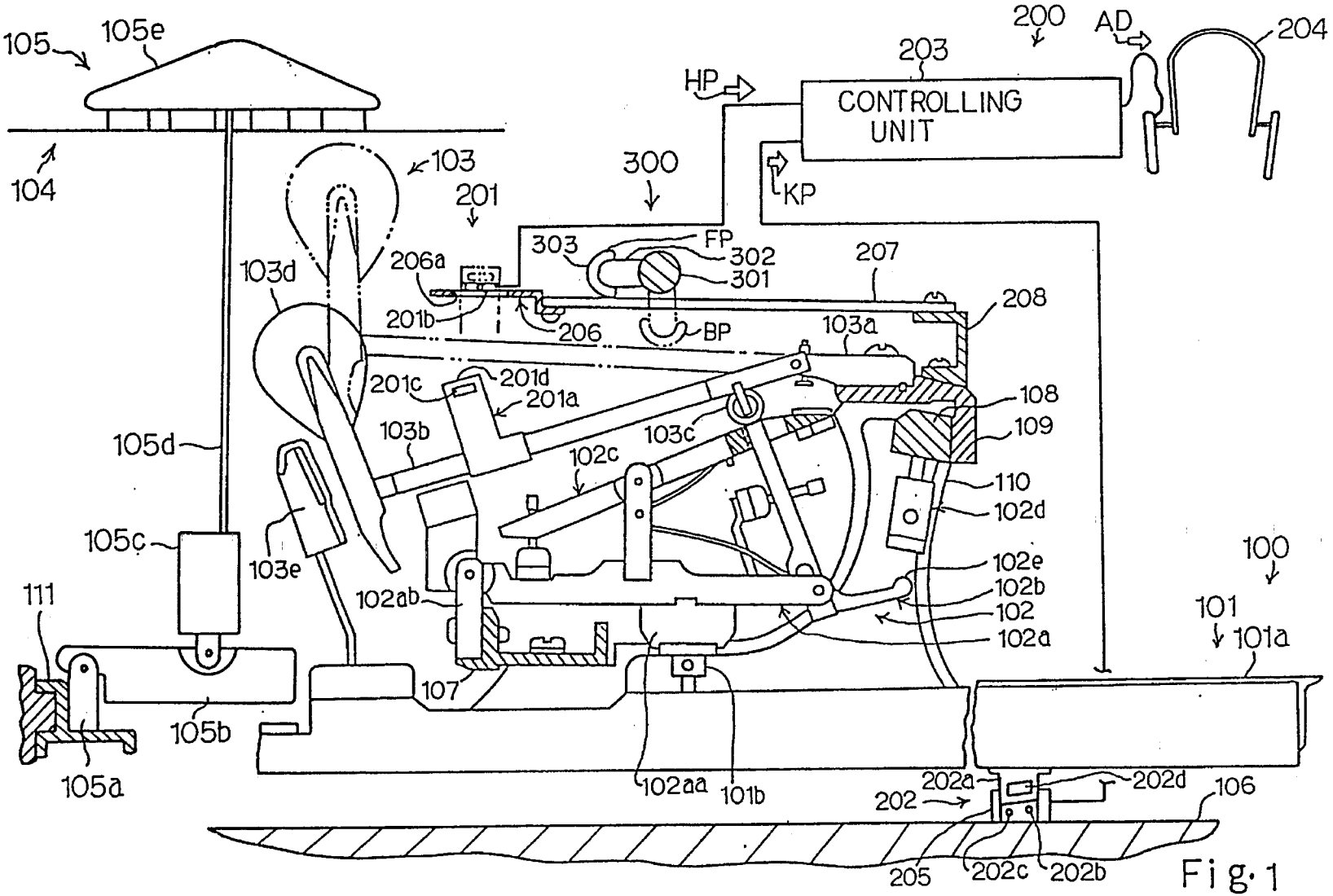
FIG. 1 is a side view showing the structure of a keyboard musical instrument according to the present invention.

Referring first to FIG. 1 of the drawings, a keyboard musical instrument embodying the present invention largely comprises an acoustic piano 100, an electronic sound generating system 200 and a silent system 300, and has at least an acoustic sound mode and an electronic sound mode. A player performs a music through acoustic sounds in the acoustic sound mode, and the electronic sound generating system 200 allows the player to perform the music through electronic sounds without the acoustic sounds in the electronic sound mode. Term "front" means a position closer to the player sitting in front of the acoustic piano than "rear" position, and directions "clockwise" and "counter clockwise" are determined in a FIG. referred to in the description.

The acoustic piano 100 is a grand piano, and includes a keyboard 101, a plurality of key action mechanisms 102 functionally connected to the keyboard 101, a plurality of hammer assemblies 103 driven for rotation by the key action mechanisms 102, a plurality of strings 104 respectively struck by the hammer assemblies 103 and a plurality of damper mechanisms 105 leaving the strings 104 before strikes of the hammer assemblies 103.

The keyboard 101 is implemented by a plurality of keys 101*a* turnable with respect to a key bed 106. Notes of a scale are respectively assigned to the plurality of keys 101*a*, and are selectively painted in black and white.

When the player depresses one of the keys 101*a*, the key 101*a* turns around a balance rail 109 (see FIG. 2) in the clockwise direction, and is moved from a rest position RST to an end position END. The key 101*a* is moved vice versa upon a release by the player.

The key action mechanisms 102 are similar in structure to one another, and each of the key action mechanism 102 includes a whippen assembly 102*a* turnable with respect to a whippen rail 107, a jack 102*b* turnably supported by the whippen assembly 102*a*, a repetition lever mechanism 102*c* swingably supported by the whippen assembly 102*a* and a regulating mechanism 102*d* supported by a regulating rail 108. The whippen assembly 102*a* has a whippen heel 102*aa* , and the whippen heel 102*aa* is held in contact with a capstan screw 101*b* upwardly projecting from a middle portion of the associated key 101*a*. A whippen flange 102*ab* is bolted to the whippen rail 107, and the whippen assembly 102*a* is turnably supported by the whippen flange 102*ab*. The whippen assembly 102*a* turns around the whippen rail 107 in the counter clockwise direction during an downward motion of the associated key 101*a* and in the clockwise direction after a release of the depressed key 101*a*.

The jack 102*a* is turnably supported by a front portion of the whippen assembly 102*a*, and is shaped into an L-letter configuration. The jack 102*a* has a toe 102*e* spaced from the regulating mechanism 102*d*. When the associated key 101*a* is depressed, the jack 102*b* turns around the whippen rail 107 together with the whippen assembly 102*a*, and pushes the hammer assembly 103. The hammer assembly 103 forcibly turns in the clockwise direction. The toe 102*e* is brought into contact with the regulating mechanism 102*d*, and the jack 102*b* quickly turns around the whippen assembly 102*a* in the clockwise direction. Then, the jack 102*b* escapes from the hammer assembly 103, and the hammer assembly 103 starts a free rotation in the clockwise direction.

The jack 102*b* escapes from the hammer assembly 103 in both of the acoustic sound mode and the electronic sound mode, and the player feels the key touch unchanged.

The hammer assemblies 103 are similar to one another, and includes a hammer shank flange 103*a* fixed to a hammer shank rail 109, a hammer shank 103*b* turnably connected to the hammer shank flange 103*a*, a hammer roller 103*c* attached to a lower surface of the hammer shank 103*b* and engageable with the jack 102*b* and a hammer head 103*d* fixed to a leading end of the hammer shank 103*b*. The hammer shank rail 109 extends between action brackets 110, and is shared between all of the hammer assemblies 103. The regulating rail 108 is attached to a rear surface of the hammer shank rail 109.

As described hereinbefore, the jack 102*b* forces the hammer shank 103*b*, the hammer roller 103*c* and the hammer head 103*d* to turn around the hammer shank flange 103*a* in the clockwise direction, and escapes from the hammer roller 103*c*. After the escape, the hammer shank 103*b*, the hammer roller 103*c* and the hammer head 103*d* start the free rotation.

A back check 103*e* projects from a rear portion of each key 101*a*, and the hammer head 103*d* is received by the back check 103*e* on the way to the home position after an impact on the string 104.

If the keyboard musical instrument is in the acoustic sound mode, the hammer head 103*d* strikes the associated string 104, and returns to the initial position. On the other hand, if the hammer assembly 103 starts the free rotation in the electronic sound mode, the silent system 300 interrupts the free rotation, and the hammer assembly 103 returns to the initial position without a strike at the string 104.

The notes of the scale are respectively assigned the plurality of strings 104, and are vibrative at respective fundamental frequencies for generating the acoustic sounds. Three music wires form each of the strings 104.

The damper mechanisms 105 are similar to one another, and each of the damper mechanisms 105 includes a damper lever flange 105*a* fixed to a damper lever rail 111, a damper lever 105*b* turnably connected to the damper lever flange 105*a*, a damper block 105*c* turnably connected to the damper lever 105*b*, a damper wire 105*d* projecting from the damper block 105*c* and a damper head 105*e* fixed to the damper wire 105*d*. The damper head 105*e* pushes down the damper lever 105*b*, and is held in contact with the associated string 104. While the damper head 105*e* is held in contact with the string 104, the leading end of the damper lever 105*b* is spaced from the rear end portion of the key 101*a*. The damper head 105*e* does not allow the string 104 to vibrate.

If the player depresses the key 101*a*, the rear end portion of the key 101*a* is brought into contact with the leading end of the damper lever 105*b*, and pushes up the damper lever 105*b*, the damper wire 105*d* and the damper head 105*e*. The damper lever 105*b* turns around the damper lever flange 105*a* in the counter clockwise direction, and the damper head 105*e* leaves the string 104 so as to allow the string 104 to vibrate upon the strike with the hammer head 103*d*.

When the player releases the key 101*a*, the key 101*a* turns in the counter clockwise direction, and the rear end portion of the key 101*a* is moved downwardly. As a result, the damper head 105*e* is brought into contact with the string 104 again.

The rear end portion of the key 101*a* directly pushes up the damper lever 105*b* in the acoustic sound mode. On the other hand, the key 101*a* is assisted with the silent system 300 in the electronic sound mode, and the damper head 105*e* similarly leaves the string 104. As a result, the load against the key 101*a* is unchanged between the acoustic sound mode and the electronic sound mode.

Thus, the key action mechanisms 102 and the damper mechanisms 105 behave unchangingly between the acoustic sound mode and the electronic sound mode, and the player feels the key touch as usual.

The electronic sound system 200 comprises a plurality of hammer sensors 201 respectively associated with the hammer assemblies 103, a plurality of key sensors 202 respectively associated with the keys 101*a*, a controlling unit 203 connected to the hammer sensors 201 and the key sensors 202 and a headphone 204 for generating the electronic sounds. The hammer sensors 201 monitor the associated hammer assemblies 103, and respectively generate hammer position signals HP indicative of the current hammer positions on the trajectories of the hammer shanks 103*b*. Similarly, the key sensors 202 monitor the associated keys 101*a*, and respectively generate key position signals KP indicative of the current key positions on the trajectories of the keys 101*a*.

The controlling unit 203 gives a priority to the hammer position signals HP, and employs the key position signals KP instead of the hammer position signals HP under predetermined conditions described hereinlater. The controlling unit 203 identifies the depressed/ released keys on the basis of the hammer position signals HP/the key position signals KP, and estimates the intensity of an impact of the hammer head 103 for each depressed key 101*a*. The controlling unit 203 tailors an audio signal AD, and supplies the audio signal AD to the headphone 204. The headphone 204 generates the electronic sounds corresponding to the acoustic sounds. The generation of the audio signal AD is similar to that disclosed in U.S. Pat. No. 5,374,775, and no further description is incorporated hereinbelow for the sake of simplicity.

The silent system 300 includes a hammer stopper 301 associated with the hammer assemblies 103. Another silent system may further includes a lifter provided for the key bed 106 and a gap regulator associated with the damper mechanisms 105. The lifter and the gap regulator are disclosed in U.S. Ser. No. 08/343,130, and no further description is incorporated hereinbelow.

A rotatable shaft member 301, bracket members 302, cushion members 303 and a driving mechanism (not shown) form in combination the hammer stopper 301. The bracket members 302 are fixed to the rotatable shaft member 301 at intervals, and the cushion members 303 are respectively attached to the bracket members 302. The driving mechanism is functionally connected to the rotatable shaft member 301, and is manipulated by the player. The driving mechanism changes the cushion members 303 between a free position FP and a blocking position BP.

The cushion members 303 are changed to the free position FP in the acoustic sound mode, and allows the hammer assemblies 103 to strike the associated strings 104 without an interruption. On the other hand, the cushion members 303 are changed to the blocking position BP in the electronic sound mode, and the hammer assemblies 103 rebound on the cushion members 303 before an impact on the strings 104.

The driving mechanism may be implemented by a link mechanism, an electric motor unit or a solenoid-operated actuator unit.

Figure 2:
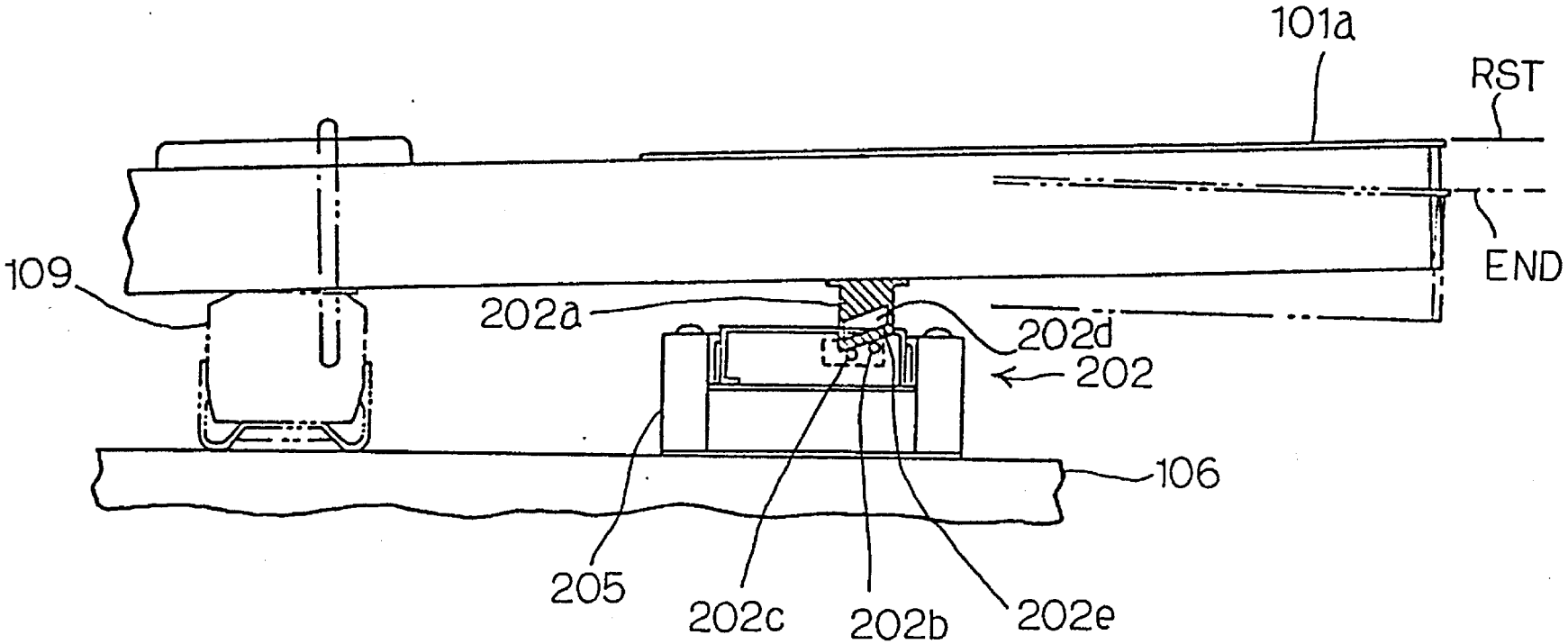
FIG. 2 is a side view showing a key sensor associated with one of the keys.

FIG. 2 illustrates the key sensor 101*a* provided for one of the keys 101*a*, and the key sensor 101*a* is supported by a frame 205 together with the other key sensors 101*a*. The other key sensors 101*a* are similar to the key sensor illustrated in FIG. 2, and are not described for avoiding repetition.

A shutter plate 202*a* and a plurality of photo-interrupters 202*b* and 202*c* form in combination the key sensor 202. The shutter plate 202*a* is attached to a lower surface of the key 101*a*, and an oblique slit 202*d* is formed in the shutter plate 202*a*. The shutter plate 202*a* is hatched in FIG. 2 for easy discrimination from the other components. While the key 101*a* is staying in the rest position RST, the bottom edge 202*e* of the shutter plate 202*a* is over the light beams of both photo-interrupters 202*b* and 202*c* as shown.

FIGS. 3A to 3D illustrate a change of the relation between the shutter plate 202*a* and the photo-interrupters 202*b* and 202*c* during a downward motion toward the end position END.

Figure 3A:
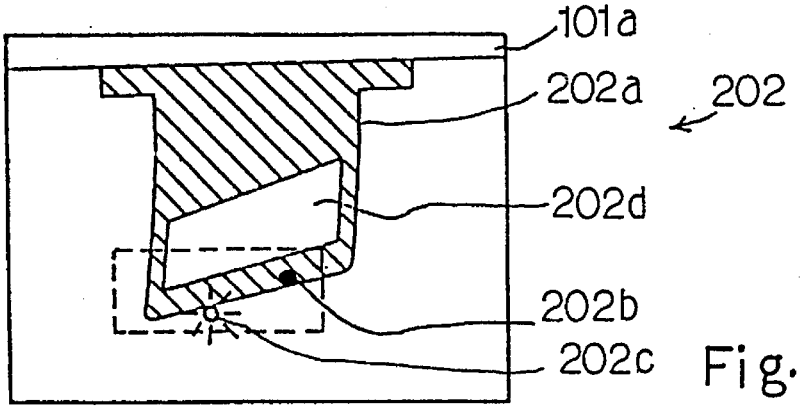
FIGS. 3A to 3D are side views showing a change of relation between a shutter plate and the key sensor during a downward motion of the key.

The shutter plate 202*a* firstly interrupts the light beam of the photo-interrupter 202*b*, and still allows the photo-interrupter 202*c* to bridge the light beam as shown in FIG. 3A. The key position illustrated in FIG. 3A is hereinbelow referred to as "K1-ON position", and the key sensor 202 is called as "K1-ON status".

Figure 3B:
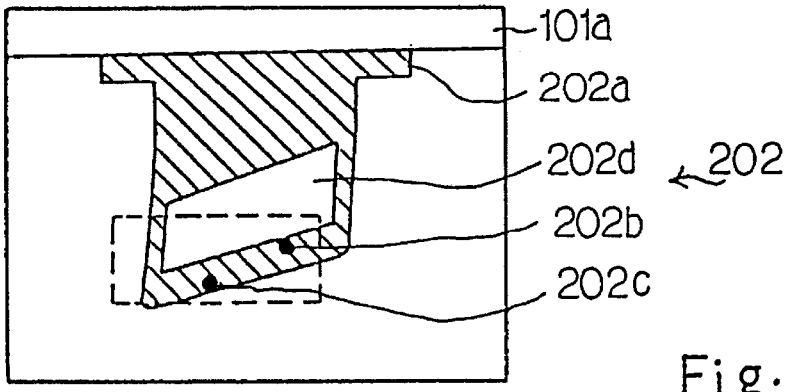

If the key 101*a* is further moved, the light beams of both photo-interrupters 202*b* and 202*c* are interrupted by the shutter plate 202*a* as shown in FIG. 3B. The key 101*a* reaches "K2-ON position", and the key sensor 202 is changed to "K2-ON status".

Figure 3C:
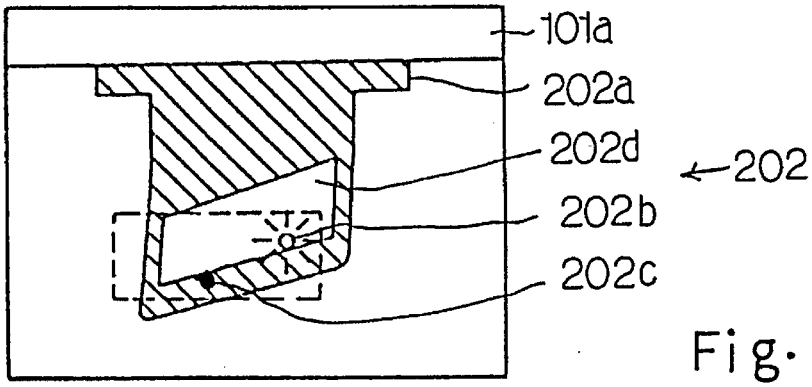

Subsequently, the shutter plate 202*a* allows the photo-interrupter 202*b* to bridge the light beam through the oblique slit 202*d*, but still interrupts the light beam of the other photo-interrupter 202*c* as shown in FIG. 3C. The key position is referred to as "K3-ON position", and the key sensor 202 enters into "K3-ON status".

Figure 3D:
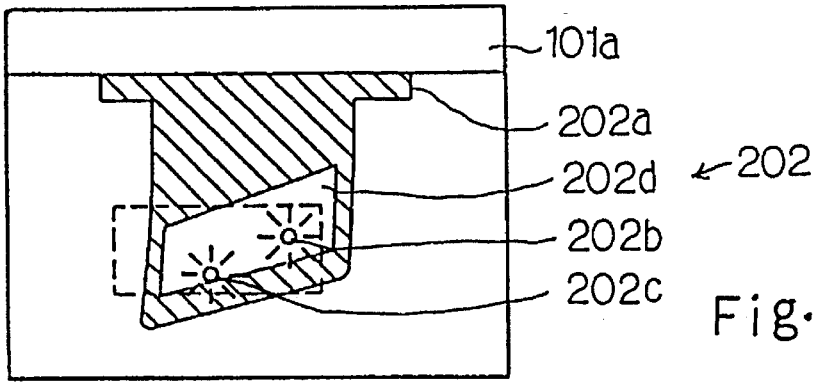

Finally, the shutter plate 202*a* allows both photo-interrupters 202*b* and 202*c* to bridge the light beams through the oblique slit 202*d* as shown in FIG. 3D. The key position is called as "K4-ON position", and the key sensor 202 enters into "K4-ON status".

The key stroke between the K1-ON position and K2-0N position is equal to the key stroke between the K2-0N position and the K3-ON position and the key stroke between the K3-ON position and the K4-ON position.

Figure 4:
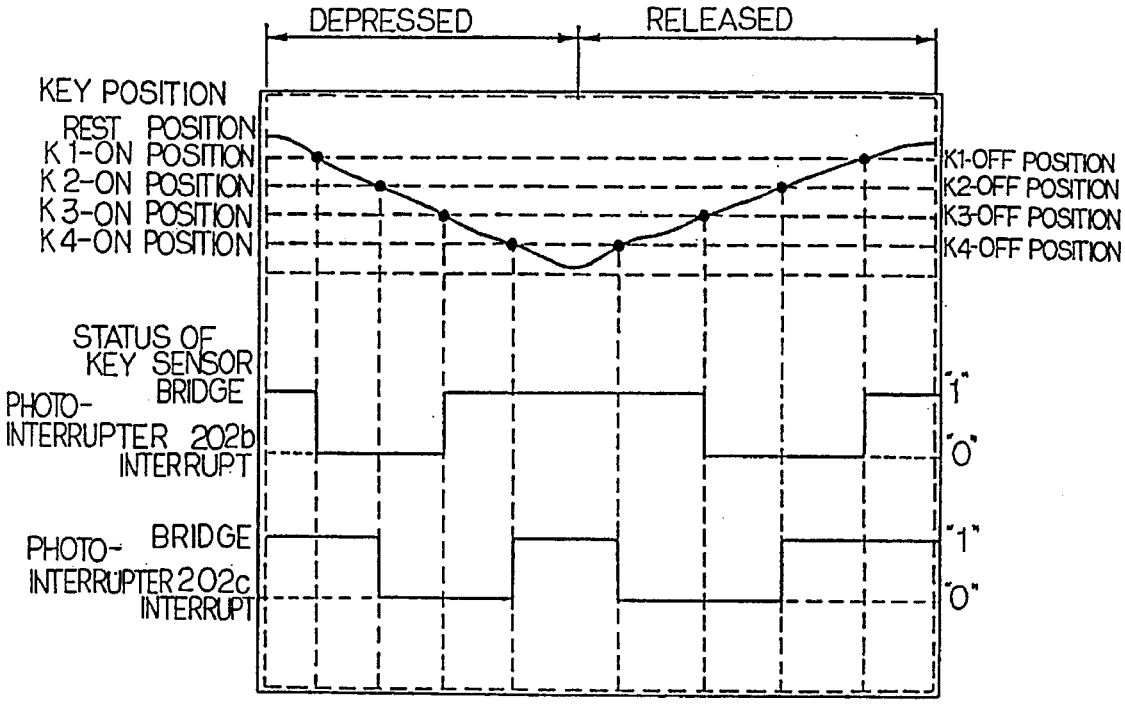
FIG. 4 is a graph showing the relation between key position and status of a key sensor during a reciprocal motion of the key.

The relation between the key 101*a* and the photo-interrupters 202 is summarized in FIG. 4, and the combination of the photo-bridge and the photo-interruption is representative of the key position.

When the depressed key 101*a* is released at the end position END, the shutter plate 202*a* selectively interrupt the light beams and selectively allow the photo-interrupters 202*b* and 202*c* to bridge the light beams during an upward motion of the released key 101*a*. The key sensor 202 changes the status from FIG. 3D through FIGS. 3C, 3B and 3A to FIG. 2. The key positions shown in FIG.s 3D, 3C, 3B and 3A in the upward motion are referred to as "K4-OFF position", "K3-OFF position", "K2-OFF position" and "K1-OFF position". Accordingly, the status of the key sensor 202 is changed from "K4-OFF status" through "K3-OFF status" and "K2-OFF status" to "K1-OFF status".

In the following description, the photo-bridge and the photo-interruption are assumed to be logic "1" level and logic "0" level, respectively. The key position signal KP is constituted by two-bits, and the bit string of the key position signal KP is representative of the key position.

Turning back to FIG. 1 of the drawings, the hammer sensors 201 are constituted by respective shutter plates 201*a* and respective photo-interrupters 201*b*. The shutter plates 201*a* are respectively attached to the hammer shanks 103*b*, and the photo-interrupters 201*b* are mounted on a plate member 206. The plate member 206 is bolted to narrow support members 207, and the narrow support members 207 in turn are bolted through a bracket 208 to the hammer shank rail 109 as shown.

Figure 5:
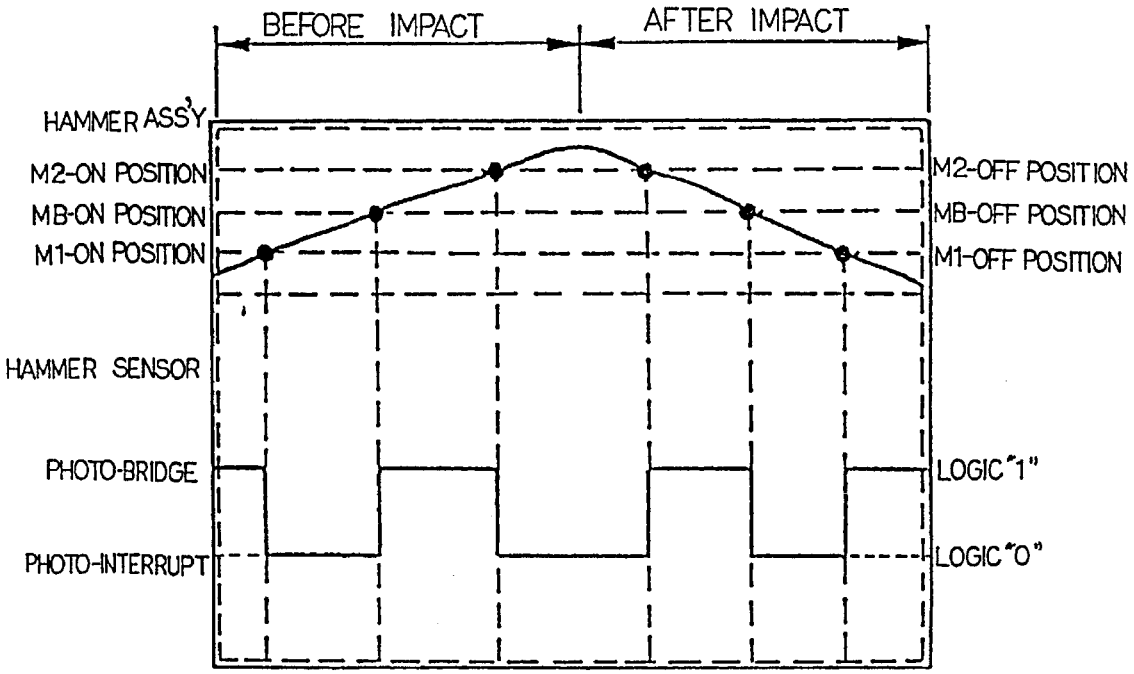
FIG. 5 is a graph showing the relation between hammer position and status of a hammer sensor during the reciprocal motion of the key.

A plurality of slits 206*a* are formed in the plate member 206, and each of the shutter plates 201*a* passes through the associated one of the slits 206*a* during the free rotation of the hammer assembly 103. A slit 201*c* is also formed in each of the shutter plates 201*a*, and the shutter plate 201*a* intermittently interrupts the light beam of the photo-interrupter 201*a* as shown in FIG. 5.

While the hammer assembly 103 is staying in the home position, the photo-interrupter 201*b* bridges the light beam. As described hereinbefore, the hammer assembly 103 and, accordingly, the shutter plate 201*a* turn around the hammer shank flange 103*a* in the clockwise direction during the downward motion of the depressed key 101*a*.

The upper edge 210*d* of the shutter plate 201*a* firstly interrupts the light beam in the rotation. The hammer position is referred to as "M1 ON posit", and the hammer sensor 201 is called as "M1-ON status".

Subsequently, the slit 201*c* allows the photo-interrupter 201*b* to bridge the light beam again, and the hammer position is called as "MB-ON position". The hammer sensor 201 enters into "MB-ON status" at the MB-ON position.

The light beam is interrupted by the shutter plate 201*a* again. The hammer assembly 103 reaches "M2-ON position" and the hammer sensor 201 enters into "M2 ON status".

After the impact on the string 104, the hammer assembly 103 falls downwardly, and the hammer assembly 103 traces "M2-OFF position", "MB-OFF position" and "M1-OFF position". Accordingly, the hammer sensor 201 changes the status from "M2-OFF" through "MB-OFF" to "M1-OFF" during the downward motion of the hammer assembly 103.

Figure 6:
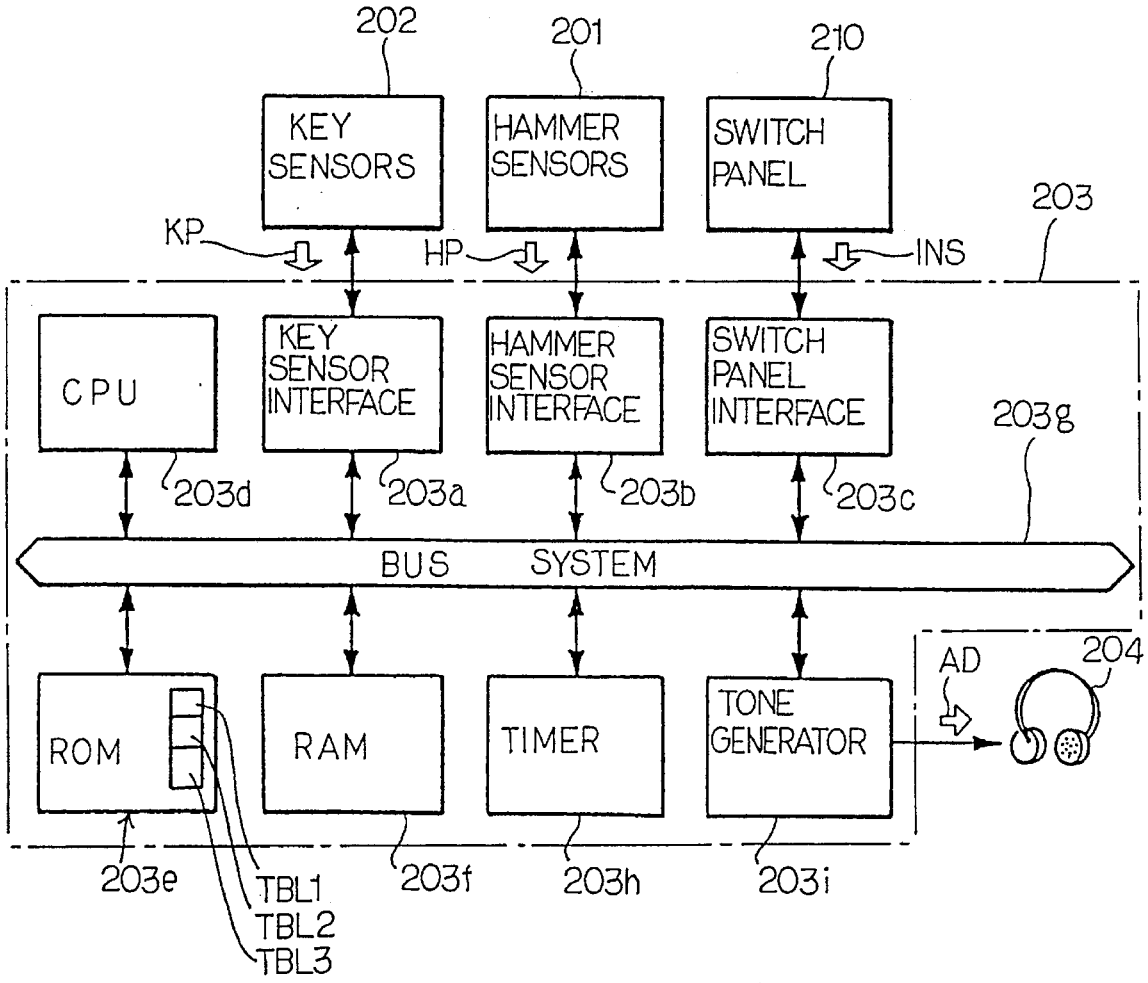
FIG. 6 is a block diagram showing the circuit arrangement of a controlling unit incorporated in the keyboard musical instrument.

Turning to FIG. 6 of the drawings, the controlling unit 203 includes three interfaces 203*a*, 203*b* and 203*c* which are respectively assigned to the key position signals KP, the hammer position signals HP and instruction signals INS supplied from a switch panel 210. Various switches and a display window are provided on the switch panel 210, and the switches are selectively manipulated by a player for selecting a timbre, the loudness of the electronic sounds etc.

If the rotatable shaft member 301 is driven for rotation by an electric motor unit, the player changes the position of the cushion members 303 through one of the switches.

The controlling unit 203 further includes a central processing unit 203*d* abbreviated as "CPU", a read only memory 203*e* abbreviated as "ROM", a random access memory 203*f* abbreviated as "RAM" and a bus system 203*g* connected to the interfaces 203*a*, 203*b*and 203*c*, the central processing unit 203*d*, the read only memory 203*e* and the random access memory 203*f*. The random access memory 203*f* provides temporary storage, and the temporary storage is under the control of the central processing unit 203*d*. Working registers are established in the temporary storage for the plurality of keys 101*a*, and are described hereinlater in detail.

Program sequences are stored in the read only memory 203*e*, and instruction codes of a selected program sequence are sequentially fetched through the bus system 203*g* by the central processing unit 203*d*. The read only memory 203*e* further contains three internal tables TBL1, TBL2 and TBL3. The first and second tables TBL1 and TBL2 are used for the estimation of the intensity of the impact or the loudness of an electronic sound on the basis of the key velocity, and the third table TBL3 defines the relation between the hammer velocity and the intensity of the impact.

The central processing unit 203*d* selectively accesses the first and second tables TBL1 and TBL2 depending upon the fingering. Namely, when the central processing unit 203*d* decides that the fingering is standard, the central processing unit 203*d* accesses the first table TBL1, and converts three kinds of calculated key velocity into respective three intensities of impact. On the other hand, if the player repeats a key 101*a* around the end position END or strongly depresses a key after a slow recovery, the impact is softer than the standard fingering, and the central processing unit 203*d* accesses the second table TBL2 instead of the first table TBL1.

The controlling unit 203 further includes a timer 203*h* and a tone generator 203*i* both connected to the bus system 203*g*.

The timer 203 sequentially increments a lapse of time, and provides a timer interrupting timing at every single millisecond to the central processing unit 203*d*.

The tone generator 203*i* is responsive to control parameters indicative of a key code and indicative of a note-on or the loudness for generating an electronic sound, and tailors the audio signal AD representing the electronic sound corresponding to an acoustic sound generated through the impact on the sting 104. When the central processing unit 203*d* supplies another control parameter indicative of a note-off to the tone generator 203*i*, the tone generator 203*i* terminates the audio signal AD. In this instance, the central processing unit supplies the control parameter indicative of the note-off upon acknowledgement of the K2-OFF status. Other control parameters are indicative of the timbre selected by the player.

One of the program sequence causes the central processing unit 203*d* to sequentially scan the three interfaces 203*a* to 203*c* to see whether or not one of the key position signal KP, the hammer position signal HP and the instruction signal INS change the status. If the key position signal KP, the hammer position signal HP or the instruction signal INS changes the status, the central processing unit 203*d* discriminates the new status, and carries out operations on working registers in the random access memory 203*f* as will be described hereinlater.

Another program sequence causes the central processing unit 203*d* to calculate the key velocities on the basis of the time interval between the K1-On status and the K2-On status, the time interval between the K2-On status and the K3-ON status and the time interval between the K3-ON status and the K4-ON status. The central processing unit 203*d* further calculates the hammer velocity on the basis of the time interval between the M1-ON status and the M2-ON status. The central processing unit 203*d* further estimates three kinds of intensity of impact on the string 104 from the key velocities, and forecasts the timings for the tone generation as will be described hereinlater. Similarly, the central processing unit 203*d* estimates an intensity of impact on the string 104 from the hammer velocity, and forecasts a timing for the tone generation.

Figures 7, 8:
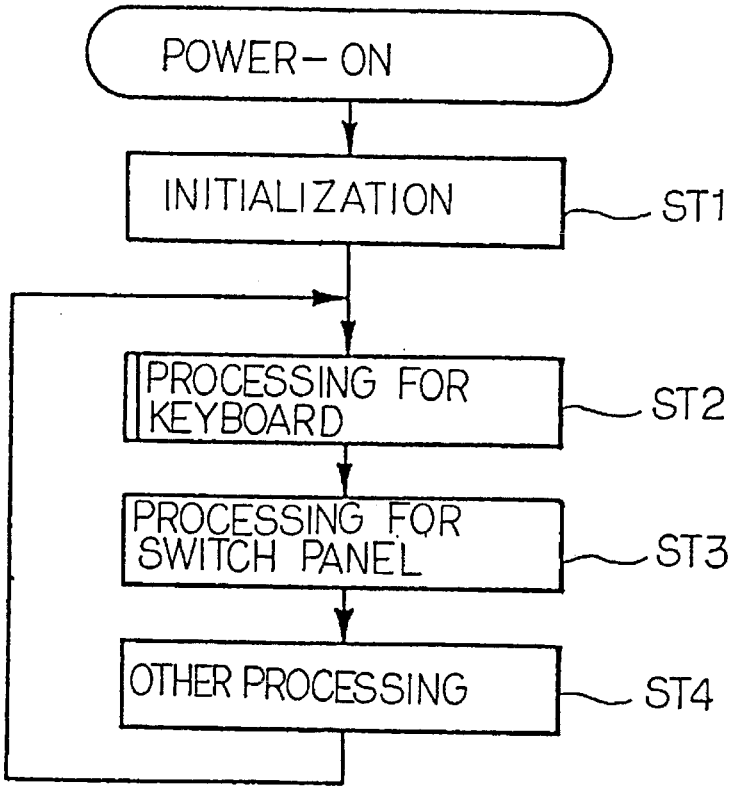
FIG. 7 is a view showing a relation between the keys and working registers.
FIG. 8 is a flow chart showing a main routine program executed by a central processing unit of the controlling unit.

FIG. 7 shows the relation between key codes KC1 to KC88 and the working registers A to N defined in the random access memory 203*f*. The key codes KC1 to KC88 are respectively assigned to the plurality of keys 101*a* forming the keyboard 101, and a set of working registers A to N is provided for each of the key codes KC1 to KC88. The working registers A to N are used for the following jobs.

Working Register A

The working register A stores time interval from the current time to the tone generation, and is called as a "key sensor event tone-generation timing counter". As described hereinbefore, the central processing unit 203*d* calculates the key velocities for the three sections of the trajectory of each depressed key 101*a*, and forecasts the timing for the tone generation from each of the key velocities . The timing for the tone generation is represented by time interval from the current time. Although three time intervals are respectively forecasted from the three key velocities, the shortest time interval is stored in the working register A for the depressed key 101*a*. The time interval is decremented at every timer interruption, and the central processing unit 203*d* generates a request for a tone generation when the time interval reaches zero. The request is hereinbelow referred to as "key sensor tone-generation request".

Working Register B

The working register B is assigned a time interval forecasted on the basis of the hammer velocity, and is called as a "hammer sensor event tone-generation timing counter". As described hereinbefore, the central processing unit 203*d* calculates the hammer velocity from a time interval between the M1-ON status and the M2-ON status, and estimates the intensity of impact on the string 104. The central processing unit 203*d* further forecasts the timing for the tone generation, and the timing for the tone generation is represented by a time interval from the current time. The central processing unit decrements the time interval at every timer interruption, and generates a request for a tone generation when the time interval reaches zero. The request is hereinbelow referred to as "hammer sensor tone generation request".

Working Register C

The working register C serves as a counter for storing a lapse of time from the K1-OFF status, and the counter is referred to as "counter C". The counter C is reset at the K1-OFF status, and is incremented at every timer interruption. When the K1-ON status takes place, the counter C stops the increment.

Working Register D

The working register D also serves as a counter D, and the counter D stores a lapse of time from the previous note-on to a tone-generation request. The counter D is incremented at every timer interruption. The tone-generation request takes place when one of the working registers A and B reaches zero.

Working Register E

The working register E also serves as a counter E, and the counter E stores a lapse of time from the K1-0N status to the K1-OFF status. The counter E starts the increment at the K1-ON status, and is incremented at every timer interruption. The counter E is reset at the K1-OFF status.

Working Register F

The working register F stores a K1 invalid flag. If the counter E exceeds a predetermined value, the K1 invalid flag is set to "1". The K1 invalid flag is reset to "0" at the K1-OFF status. The K1 invalid flag is indicative of whether or not the associated key 101*a* is continuously depressed over a predetermined time.

Working Register G

The working register G serves as a counter G, and the counter G stores a lapse of time from the K2-ON status. The counter G is allowed to increment the lapse of time in response to every timer interruption at the K2-On status, and is reset at the K2-OFF status.

Working Register H

The working register H stores a K2 invalid flag. When the counter G exceeds a predetermined value, the K2 invalid flag is set to "1". The K2 invalid flag is reset to "0" at the K2-OFF status. The K2 invalid flag is indicative of whether or not the associated key 101*a* continuously remains around the K2-ON position over a predetermined time.

Working Register I

The working register I serves as a counter I, and the counter I stores a lapse of time from the K2-ON status. The counter I is allowed to increment the lapse of time in response to every timer interruption at the K2-ON status as similar to the counter G. However, the counter I is reset at not only the K2-OFF status but also the tone-generation request.

Working Register J

The working register J stores a silent note flag. When the counter I exceeds a predetermined value, the silent note flag is set to "1". The silent note flag is reset to "0" at one of the K2-OFF status and the tone-generation request. The silent note flag is indicative of whether or not the associated depressed key 101*a* does not cause the hammer assembly 103 to start the free rotation.

Working Register K

The working register K stores a note-on flag. The note-on flag is set to "1" at the note-on, and is reset to "0" at the K2-OFF status. The note-on flag is indicative of whether or not the associated key 101*a* is maintained below the K2-OFF position after the tone-generation request.

Working Register L

The working register L stores a previous selected intensity of impact finally employed for the tone generation.

Working Register M

The working register M stores a selected intensity of impact. As described hereinbefore, the central processing unit 203*d* estimates three kinds of intensity of impact on the basis of the three key velocities, and forecasts respective timings for the tone generation. The central processing unit 203*d* selects the intensity of impact associated with the earliest timing for the tone generation, and write it in the working register M as the selected intensity of impact. The selected intensity of impact is canceled upon the tone generation request.

Working Registers N

The working registers N stores various data information such as a time interval from the M1-ON status to the current time, a time interval between the MI-0N status and the MB-ON status, an intensity of impact on the string 104 estimated from the hammer velocity and control data for managing the outputs of the hammer sensors 201 and the key sensors 202.

Behavior in Acoustic Sound Mode

When the player wants to perform a music through acoustic sounds, the driving mechanism (not shown) is manipulated by the player, and the cushion members 303 are changed to the free position FP. Of course, if the cushion members 303 have already changed to the free position FP, the player starts the music without a manipulation of the driving mechanism.

The key 101*a* is assumed to be depressed in the performance. The key 101*a* is rotated in the clockwise direction, and the capstan screw 101*b* pushes up the whippen heel 102*aa*. The whippen assembly 102*a* and the jack 102*b* turn around the whippen flange 102*ab* in the counter clockwise direction, and the jack 102*b* forces the hammer shank 103*b* and the hammer head 103*d* to turn around the hammer shank flange 103*a* in the clockwise direction.

The rear end portion of the key 101*a* pushes up the damper lever 105*b*, and the damper lever 105*b* turns around the damper lever flange 105*a* in the counter clockwise direction. The damper lever 105*b* lifts the damper block 105*c*, the damper wire 105*d* and the damper head 105*e*, and the damper head 105*e* leaves the string 104. Thus, the string 104 is allowed to vibrate. The string 104 generates the acoustic sound with the note corresponding to the depressed key 101*a* through the vibrations.

The toe 102*e* is getting closer and closer to the regulating button mechanism 102*d* during the downward motion of the key 101*a*, and is brought into contact with it. Although the whippen assembly 102*a* continuously turns around the whippen flange 102*ab* in the counter clockwise direction, the regulating button mechanism 102*d* interferes the jack 102*b*, and, accordingly, the jack 102*b* turns around the whippen assembly 102*a* in the clockwise direction. Then, the jack 102*b* escapes from the hammer roller 103*c*, and imparts kinetic energy to the hammer assembly 103. The damper mechanism 105 and the escape of the jack 102*b* give the unique key touch to the player.

Then, the hammer shank 103*b* and the hammer head 103*d* start a free rotation, and the hammer head 103*d* impacts the string 104 without an interruption of the hammer stopper. The hammer head 103*d* rebounds on the string 104, and downwardly falls. The back check 103*e* receives the hammer head 103*d*.

When the player releases the key 101*a*, the key 101*a* turns in the counter clockwise direction, and allows the whippen assembly 102*a* to turn in the clockwise direction. The jack 102*b* returns to the initial position beneath the hammer roller 103*c*, and the hammer assembly 103 returns to the home position.

Thus, the keyboard musical instrument according to the present invention behaves as similar to a standard grand piano in the acoustic sound mode.

Behavior in Electronic Sound Mode

When the player wants to perform the music through the electronic sounds, the player manipulates the driving mechanism, and the cushion members 303 enter into the blocking position. The cushion members 303 are opposed to the hammer shanks 103*b*.

The key 101*a* is depressed by the player, and the capstan screw 101*b* pushes up the whippen heel 102*aa*. The whippen assembly 102*a* and the jack 102*b* turn around the whippen flange 102*ab* in the counter clockwise direction, and the jack 102*b* forces the hammer shank 103*b* and the hammer head 103*d* to turn around the hammer shank flange 103*a* in the clockwise direction. The rear end portion of the depressed key 101*a* lifts the hammer head 105*e* through the damper lever 105*b*, the damper block 105*c* and the damper wire 105*d*, and the damper head 105*e* leaves the string 104.

When the toe 102*e* is brought into contact with the regulating button mechanism 102*d*, the jack 102*b* escapes from the hammer roller 103*c*, and gives kinetic energy to the hammer assembly 103. The damper mechanism 105 and the escape of the jack 102*b* gives the same unique key touch to the player.

The hammer assembly 103 starts the free rotation upon the escape of the jack 102*b* as similar to that in the acoustic sound mode. However, the hammer shank 103*b* rebounds on the cushion member 303 before an impact on the string 104. For this reason, the string 104 does not generates the acoustic sound.

After a release of the depressed key 101*a*, the key action mechanism 102, the damper mechanism 105 and the hammer assembly 103 behave as similar to those in the acoustic sound mode.

On the other hand, the electronic sound generating system 200 behaves as follows. FIG. 8 illustrates a main routine program stored in the read only memory 203*e*. When the electronic sound generating system 200 is powered, the central processing unit 203*d* initializes the system as by step ST1. While the central processing unit 203*d* is initializing the system, the counters, the flags and the other working registers are reset.

After the initialization, the central processing unit 203*d* proceeds to step ST2, and monitors the interfaces 203*a* and 203*b* to see whether or not any one of the key position signals KP and the hammer position signals HP changes the status.

If one of the keys 101*a* is depressed, the depressed key 101*a* traces the K1-ON position, the K2-ON position, the K3-ON position and the K4-ON position, and the associated key sensor 202 changes the key position signal KP through the K1-ON status, the K2-ON status, the K3-ON status and the K4-ON status. The central processing unit 203*d* calculates the three kinds of key velocity from the time intervals between the K1-ON status and the K2-ON status, between the K2-ON status and the K3-ON status and between the K3-ON status and the K4-ON status. The central processing unit 203*d* accesses one of the first and second tables TBL1 and TBL2 , and estimates the intensity of the impact from each of the three kinds of key velocity. The central processing unit 203*d* forecasts the timings for the tone generation through the linear predictive method, and writes the earliest timing in the working register A. However, if the working register A stored a timing for the tone generation closer to the current time than the forecasted earliest timing, the newly forecasted timings are invalid, and the earliest timing is not written into the working register A.

The key motion causes the jack 102*b* to escape from the hammer assembly 103, and the hammer assembly starts the free rotation. Then, the hammer sensor 201 is changed through the M1-ON status, the MB-ON status and the M2-ON status. The central processing unit 203*d* calculates the hammer velocity from the time interval between the M1-0N status and the M2-ON status, and accesses the third table TBL3 so as to estimate the intensity of the impact on the string 104. The central processing unit 203*d* forecasts the timing for the tone generation through the linear productive method, and writes the intensity of impact and the timing for the tone generation into the working registers N.

Upon completion of the scanning the interfaces 203*a* and 203*b*, the central processing unit 203*d* proceeds to step ST3, and checks the interface 203*c* to see whether or not one of the instruction signals INS changes the status. If there is at least one instruction signal changing the status, the central processing unit 203*d* changes corresponding parameters stored in the other working registers.

When the processing for the switch panel 210 is completed, the central processing unit 203*d* proceeds to step ST4, and carries out other jobs necessary for the electronic sound generation.

Thus, the central processing unit 203*d* reiterates the loop consisting of steps ST1 to ST4. As described hereinbefore, the timer interruption takes place at every 1 millisecond, and the central processing unit 203*d* carries out the jobs described in conjunction with the working registers A to N at every timer interruption.

When the tone generation request takes place, the tone generator 203*i* tailors the audio signal AD representing an electronic sound corresponding to the acoustic sound expected upon the impact on the string 104, and the headphone 204 generates the electronic sound.

When the timing for the tone termination comes, the tone generator 203*i* decays the audio signal AD, and the headphone 204 terminates the electronic sound.

As described hereinbefore, the timer 203*h* generates the timer interruption at every millisecond. As described hereinbefore, the central processing unit 203*d* increments and decrements the working registers A, B, C, D, E, G, I and N at every timer interruption, and the value stored in each of those working register is representative of time in millisecond.

Upon generation of the key sensor tone-generation request or generation of the hammer sensor tone-generation request, the central processing unit 203*d* branches the program depending upon the flags stored in the working registers F, H, J and K and the values of the counters C and D. The sub-programs after the branch are hereinbelow referred to as sub-modes A, B, C, D, E, F, G and H. The central processing unit determines the table TBL1 /TBL2 to be accessed and the intensity of impact to be used for the audio signal AD depending upon the sub-mode.

FIG. 9 illustrates the branch to the sub-modes A to H. In the sub-mode A, the central processing unit 203*d* estimates the intensity of impact on the basis of the hammer position signals HP, and does not access a table.

The central processing unit 203*d* usually estimates the intensity of impact on the basis of the hammer position signals HP in the sub-modes B to E. However, if conditions described hereinlater are satisfied, the central processing unit 203*d* accesses the first table TBL1 in the sub-modes B and C and the second table TBL2 in the sub-modes D and E.

The central processing unit 203*d* estimates the intensity of impact on the basis of the key position signals KP in the sub-modes F, G and H, and accesses the second table TBL2.

The sub-modes A to H are described in detail.

Sub-Mode A

When zero is stored in the working registers F, H, J and K and the counter C is equal to or greater than 127, the key passes through the K1-OFF position after 127 milliseconds from the previous key release, and is simply depressed by the player. In other words, the key is depressed from the rest position RST to the end position END, and is released at the end position END. In this situation, the central processing unit estimates the intensity of impact and forecasts the timing for the tone generation on the basis of the hammer position signal HP, because the hammer motion directly results in the impact on the string 104 in the acoustic sound mode.

Sub-Mode B

Even if zero is stored in the working registers F, H, J and K, the counter C less than 127 millisecond means that the key is depressed immediately after the key release. Especially, the counter C is equal to or greater than 38 milliseconds in the sub-mode B, and is indicative of the return of the jack 102*b* to the position beneath the hammer roller 103*c*. The jack 102*b* gave the kinetic energy to the hammer assembly upon the escape therefrom, and the hammer motion is expected to define the intensity of impact as similar to the sub-mode A. For this reason, the central processing unit estimates the intensity of impact and forecasts the timing for the tone-generation on the basis of the hammer position signal HP.

However, if the conditions are satisfied, the central processing unit 203*d* estimates the intensity of impact and forecasts the timing for the tone-generation on the basis of the key position signal KP. The central processing unit 203*d* accesses the first table TBL1 in the estimation.

Sub-Mode C

Although the working registers F, H, J and K store zero, the counter C less than 38 milliseconds means an extremely high-speed repetition. In the sub-mode C, the counter D is equal to or less than 150 milliseconds, and the player rapidly releases the key in the previous fingering. The jack 102*b* had returned to the position beneath the hammer roller 103*c*, and the jack 102*b* gave the kinetic energy to the hammer assembly 103. For this reason, the hammer motion exactly defines the intensity of impact, and the central processing unit 203*d* estimates the intensity of impact and forecasts the timing for the tone-generation on the basis of the hammer position signal HP.

However, if the conditions are satisfied, the central processing unit accesses the first table TBL1 so as to estimate the intensity and forcast the timing as similar to the sub-mode B.

Sub-Mode D

Zero in the working registers F, H, J and K, the counter C less than 38 milleseconds and the counter D not less than 150 millesecoinds resut in the sub-mode D. The counter C less than 38 milleseconds means an extremelky high-speed repetition, and the counter D not less than 150 milliseconds indicates that the key was slowly released in the previous fingering. The jack 102*b* had imperfectly returned to the position beneath the hammer roller 103*c*, and gave kinetic energy smaller than that of the sub-modes A to C. For this reason, the central processing unit 203*d* estimates the intensity of impact and forcasts the timing for the tone-generation on teh basis of the key position signal KP. The central processing unit 203*d* accesses the second table TBL2.

Sub-Mode E

If the working register F stores "1", the central processing unit 203*d* is brached to the sub-mode E. The K1 invalid flag is assigned to the working register F, and the K1 invalid flag "1" is indicative of the key below the K1-ON position confinued for long time period. This means that the player repeated the key at a deep position. In case of the estination on the basis of the key position signaol KP, the central processing unit 203*d* accesses the second table TBL2 so as to estimate the intensity and forcast the timing.

Sub-Mode F

The wroking register H stores the K2 invalid flag. The K2 invalid flag of "1" is indicative of the key continuously below the K2-ON position, and the player depresed the key at a deep position. The assoicaited hammer assembly has possibly passes the M1-ON position, and the central processing unit accesses the second table TBL2 for the estimation and the forcasting.

Sub-Mode G

If the working register J store "1", the sub-mode G takes place. Even though the depressed key 101*a* passed through the K2-ON position, the note-on deos not takes place in the sub-mode G. This fingering is a kind of the deep key depressing. However, the associated hammer assembly possibly reached the M1-ON position, and the central processing unit 203*d* estimates the intenisty of impact and forcasts the timing for the tone-generation on the basis of the key position signal KP. The central prossesing unit 203*d* accesses the second table TBL2.

Sub-Mode H

In the sub-mode H, the working register K stores "1". Although the depressed key 101*a* had been released, the released key 101*a* did not pass through the K2-OFF position, and the note-on takes place. This fingering is also a kind of the deep key depressing, and the assoicated hammer assembly possibly passed the M1-ON position, and the central processing unit 203*d* employs the key position signal KP. The central processing unit accesses the second table TBL2.

Figure 10:
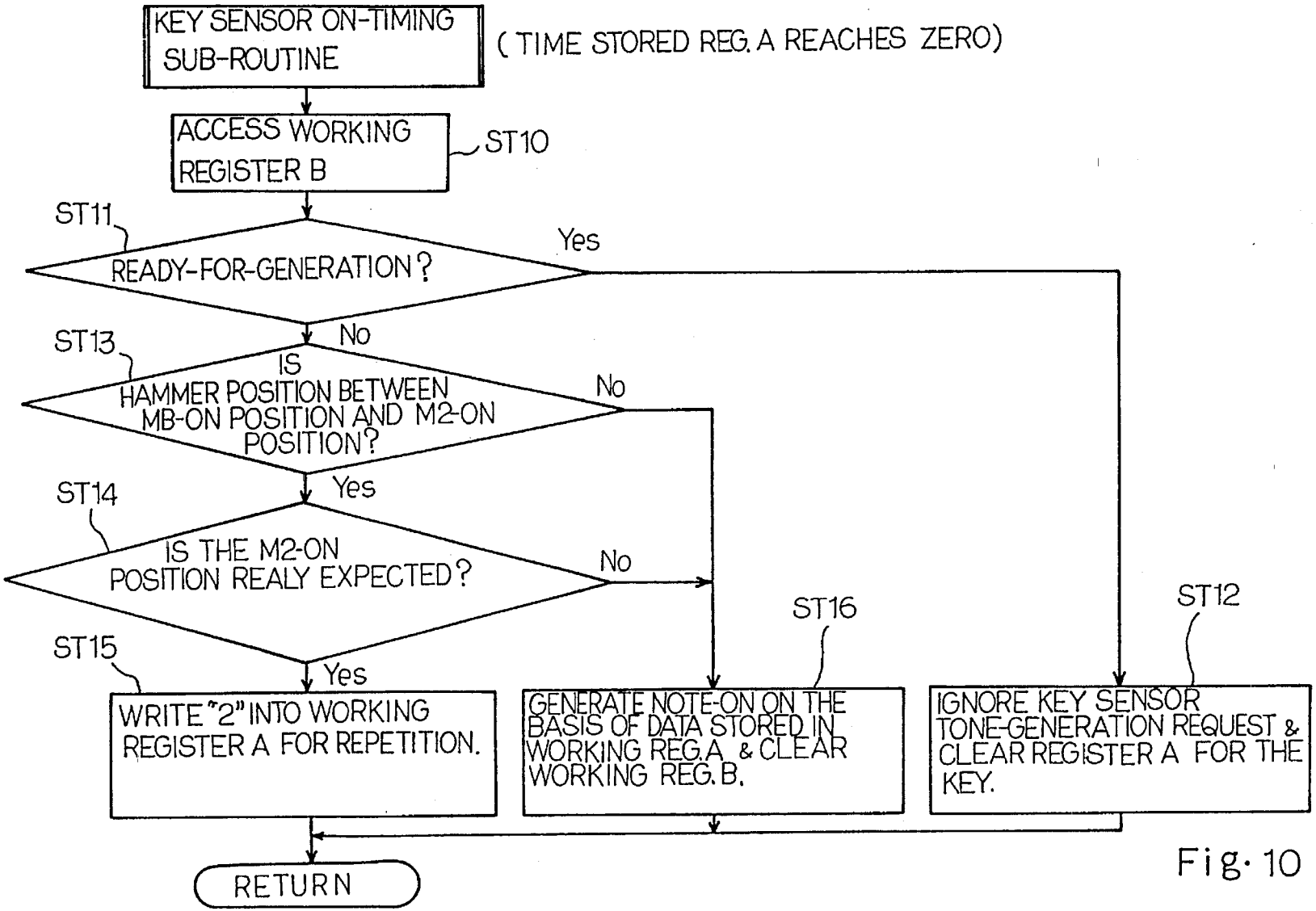
FIG. 10 is a flow chart showing a selection between a key position signal and a hammer position signal in case where a working register reaches zero.

Subsequently, description is made on the selection between the hammer position signal HP and hte key position signal KP in one of the sub-modes B to E. As described hereinbefore, the tone-generation request takes place when the working register A or the working register B reaches zero. When the tone-generation request takes place in response to the working register A reaching zero, the central procesing unit 203*d* is branched to a key sensor on-timing sub-routine, and FIG. 10 illustrates the key sensor on-timing sub-routine. On the other hand, when the tone-generation request takes place in response to the working register B reaching zero, the central processing unit 203*d* is branched to a hammer sensor on-timing sub-routine illustrated in FIG. 11.

According to FIG. 10, when the working register A reaches zero, the central processing unit 203*d* accesses the working register B, and fetches the data stored therein as by step ST10. The central processing unit 203*d* checks the data to see whether or not the working register B has already stored ready-for-generation state as by step ST11. If the working register B has stored the hammer velocity and the time interval for the tone generation after the change of the associated hammer assembly 103 from the M1-0N position through the M2-ON position, it is said that "the working register B stores the ready-for-generation state".

If the answer at step ST11 is given affirmative, the central processing unit 203*d* proceeds to step ST12, because the tone generator 203*i* will tailor the audio signal AD soon on the basis of the data stored in the working register B. The central processing unit 203*d* ignores the data stored in the working register A, and clears the working register A.

On the other hand, if the answer at step ST11 is given negative, the central processing unit 203*d* checks the data fetched from the working register B to see whether or not the associated hammer assembly is traveling between the MB-ON position and the M2-ON position as by step ST13.

If the answer at step ST13 is given affirmative, the M2-On status will soon take place, and the central processing unit 203*d* proceeds to step ST14. The central processing unit 203*d* checks the working registers N to see whether or not the lapse of time between the M1-ON position and the MB-ON position and the lapse of time between the M1-ON position and the current time allow us to really expect the M2-ON position.

If both answers at steps ST13 and ST14 are affirmative, the central processing unit 203*d* proceeds to step ST15, and writes "2" into the working register A. This means that the central processing unit repeats the key sensor on-timing sub-routine 2 milliseconds after the current time.

On the other hand, if the answer at least one of the steps ST13 and ST14 is given negative, the central processing unit 203*d* decides the hammer motion to be unusual, and proceeds to step ST16. The central processing unit employs the intensity of impact estimated from the key motion, and generates the note-on. The table to be accessed is dependent on the sub-mode. The central processing unit 203*d* clears the working register B for the key 101*a*.

Figure 11:
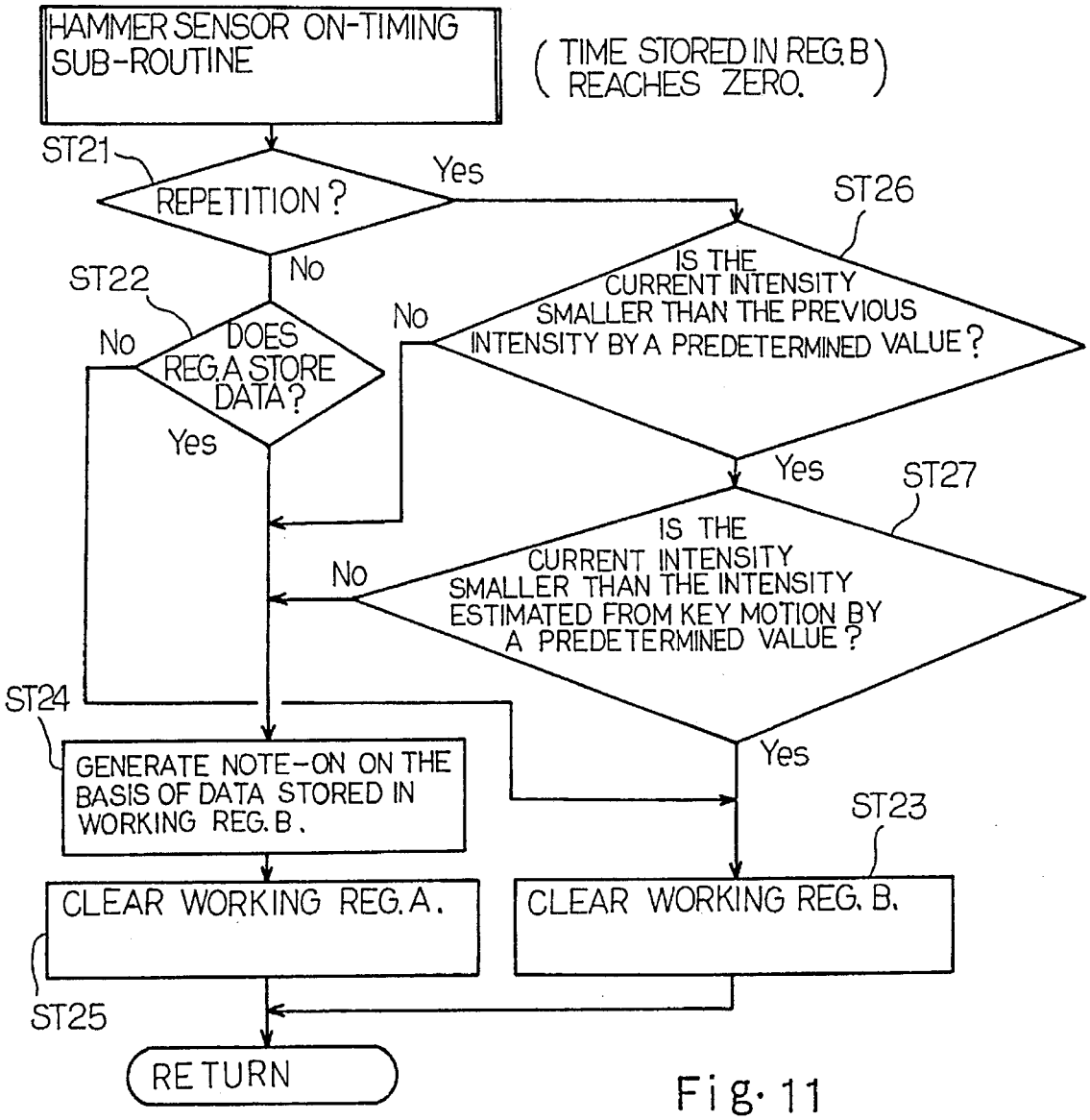
FIG. 11 is a flow chart showing a selection between the key position signal and the hammer position signal in case where another working register reaches zero.

If the tone-generation request takes place on the basis of the time stored in the working register B, the central processing unit 203*d* is branched to the hammer sensor on-timing sub-routine shown in FIG. 11.

The central processing unit 203*d* firstly decides whether or not a repetition takes place as by step ST21. In detail, the central processing unit 203*d* checks the working register D to see whether or not the time data stored therein is equal to be less than 256. The working register D stores the lapse of time from the previous note-on.

If the lapse of time is long, i.e., greater than 256 milliseconds, the central processing unit 203*d* acknowledges a standard fingering, and checks the working register A to see whether or not any data is stored as by step ST22. As described hereinbefore, the hammer sensors 201 tends to chatter due to the impact of the hammer assembly 103. If the hammer sensor 201 had chattered, the hammer sensor 201 varied the hammer position signal HP, and the status of the hammer position signal HP was stored in the working register B. However, the associated key 101*a* had not been depressed, and any data is not stored in the working register A. For this reason, the central processing unit decides whether or not the chattering took place on the basis of the data stored in the working register A.

When the central processing unit 203*d* decides that the data stored in the working register B is indicative of the chattering, the central processing unit 203*d* proceeds to step ST23, and clears the working register B for the key 101*a*.

On the other hand, if the working register A stores the data, the central processing unit 203*d* proceeds to step ST24, and generates the note-on on the basis of the intensity of impact estimated from the hammer velocity. Thereafter, the central processing unit 203*d* clears the working register A for the key 101*a* as by step ST25.

When the central processing unit acknowledges the repetition at step ST21, the central processing unit 203*d* treats the data as follows.

Figure 12:
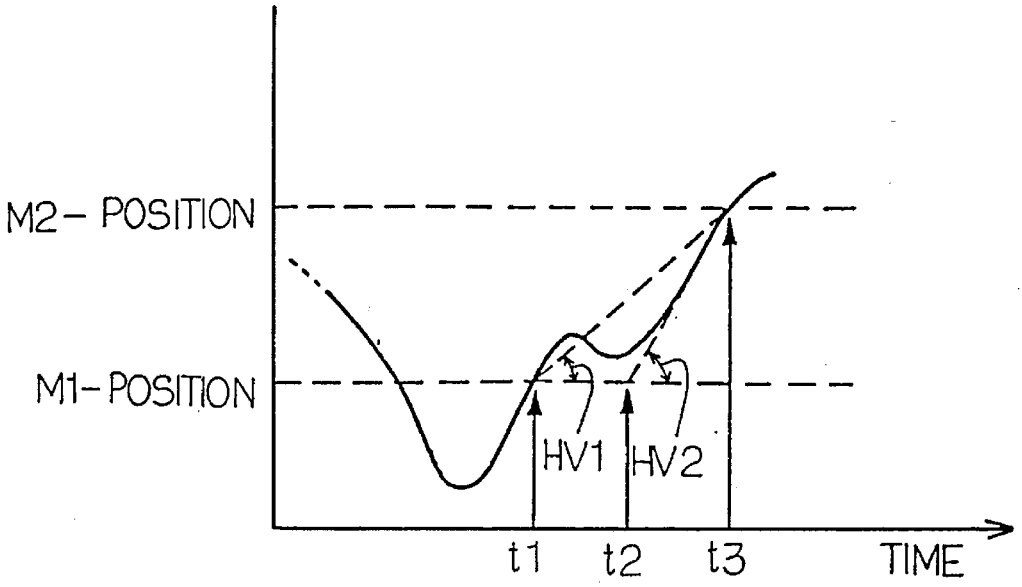
FIG. 12 is a diagram showing a trajectory of a key in a repetition.

Turning back to FIG. 1, the keyboard musical instrument encounters a following problem in the repetition. The repetition means repeated quick depressing/releasing action. Even if the hammer assembly 103 returns after the impact on the string 104, the key 101*a* is not maintained around the end position END at all times. If the key 101*a* is in or around the rest position RST at the return of the hammer assembly, the hammer roller 103*c* is brought into collision with the repetition lever 102*c*, and the hammer assembly 103 rebounds thereon. The rebounding hammer assembly 103 is liable to cause the upper edge 201*d* of the shutter plate 201*a* to interrupts the light beam of the photo-interrupter 201*b* at time t1 in FIG. 12, and the hammer position signal HP is undesirably changed to the M1-ON status. If the player depresses the key immediately after the change to the M1-ON state at time t2, the hammer assembly restarts the free rotation without passing through the M2-ON position, and the hammer assembly 103 passes through the M2-ON position at time t3 without the M1-On position. Accordingly, the hammer sensor 201 changes the hammer position signal HP to the M2-status. However, the hammer velocity HV1 calculated from the time interval is smaller than the actual hammer velocity HV2, because an M2-ON status and an M1-ON status are missing.

A path through steps ST26 and ST27 is provided so as to cope with the inconsistence between the calculated hammer velocity and the actual hammer velocity. The central processing unit 203*d* firstly checks the working register L to see whether or not the current intensity of impact is smaller than the previous intensity of impact by a predetermined value. The intensity of impact is usually not so widely changed in the repetition, and the predetermined value is of the order of 20.

If the answer at step ST26 is given negative, the data in the working register B are reliable, and the central processing unit 203*d* proceeds to step ST24.

On the other hand, if the answer at step ST26 is given affirmative, the central processing unit 203*d* proceeds to step ST27, and accesses the working register M. The central processing unit 203*d* checks the working register M to see whether the intensity of impact estimated from the hammer motion is smaller than the intensity of impact estimated from the key motion by another predetermined value. The predetermined value at step ST27 is of the order to 15. If the answer at step ST27 is given negative, the central processing unit 203*d* decides the data stored in the working register B to be valid, and proceeds to step ST24.

However, if both answer at steps ST26 and ST27 are given affirmative, the data stored in the working register B are possibly formed on the basis of the undesirable chattering, and the central processing unit 203*d* cancels the data stored in the working register B.

Thus, when the hammer sensor tone-generation request takes place earlier than the key sensor tone-generation request, the central processing unit 203*d* analyzes the data stored in the working registers A, B, D, L and M, and decides whether to generate the note-on or not.

As will be appreciated from the foregoing description, the central processing unit mainly generates the note-on on the basis of the hammer motion, and alternatively generates the note-on on the basis of the key motion in case of unreliable hammer data. The central processing unit 203*d* effectively discriminates the hammer data assumed to be formed due to the chattering, and eliminates unintentional electronic sound from the reproduced music. The central processing unit further discriminates a simple delay of the hammer sensor tone-generation request, and retards the note-on.

Although the central processing unit 203*d* generates the note-on on the basis of the hammer motion without any consideration in the sub-mode A. However, the central processing unit 203 may branch the control in the sub-mode A as similar to the sub-modes B and C.

In this instance, the working registers A to N are provided to each of the eighty-eight keys 101*a*. However, the working registers A to N may be provided for each of the electronic sounds concurrently produced. In this instance, each set of the working registers A to N is shared between the keys 101*a*, and event data are assigned to one of the sets in a time sharing manner.

In this instance, the central processing unit 203*d* and the working register A as a whole constitute a first means, and the working register B forms a second means together with the central processing unit 203*d*. The working registers C to N, the central processing unit 203*d* and steps ST10, ST11, ST13 to ST15, ST21, ST22, ST26 and ST27 as a whole constitutes a third means, and the central processing unit 203*d* and steps ST12, ST16, ST23, ST24 and ST25 serve as a fourth means.

Modifications

Figure 13:
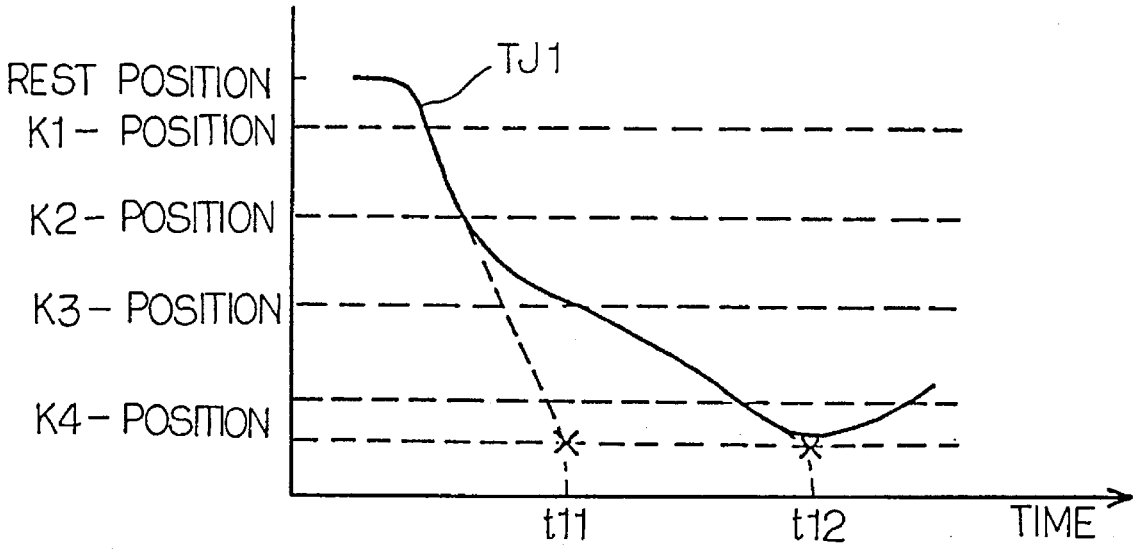
FIG. 13 is a diagram showing another trajectory of a key.

In case where a key traces a trajectory TJ1 shown in FIG. 13, there is a possibility that the note-on is generated twice, i.e., at time t11 and time t12. In order to eliminate the double tone generation from the keyboard musical instrument, one of or both of the following processings A and B are employed.

Processing A: If the second note-on is within 30 milliseconds from the first note-on, the central procesing unit ignotes the second note-on.

Processing B: Even if the note-on is repeated for the same key, the central processing unit ignores the second note-on in so far as the key passes through a critical position such as the K3-OFF position or the K4-OFF position.

In the above described embodiemnt, the note-off is simply generated at the K2-OFF status. If the next note-on takes place before the K2-OFF status, a modification does not process the note-off, and makes the performance through the electronic sounds closer to the performance through the acoustic sounds.

Another modification calcualtes a released key velocity, and forcasts a timing for a note-off. In this instance, the released key velocity is calcualted from the time interval between the K3-OFF status and the K2-OFF status.

Yet another modifciation gradually decays the electronic sound. For example, the tone generator starts the decay at the K3-OFF status, and terminates the electrnic sound at the K2-OFF status.

The keyboard musical instrument according to the present invneion may further comprise key actuators for an automatic playing and/or a recording system for storing the original performance on the keybaord.

Although a particular embodiment of the present invention has been shown and described, it will be obvious to those skilled in the art that various changes and modifications may be made without departing from the spirit and scope of the present invention. For example, another model of an acoustic piano may have the critical values of the counters C and D different from 127 milliseconds, 38 milleseconds and 150 milliseconds.

The present invention is applicable to an automatic playing piano so as to generate a series of music data codes, and may reproduce a music by using the music data codes.

What is claimed is:

1. A keyboard musical instrument comprising:

an acoustic piano including a plurality of keys responsive to fingerings of a player so as to turn around a stationary board member, a plurality of key action mechanisms functionally connected to said plurality of keys, a plurality of strings corresponding to said plurality of keys, respectively, and a plurality of hammer assemblies respectively driven for rotations by said plurality of key action mechanisms, and respectively striking said plurality of strings through said rotations for generating acoustic sounds; and an electronic system including a plurality of key sensors respectivley associated with said plurality of keys for monitoring key motions, and producing key position signals each indiative of an actual key position of the associated key, a plurality of hammer sensors respectively associated with said plurality of hammer assemblies for monitoring hamer motions, and producing hammer position signals each indicative of an actual hammer position of the associated hammer assembly, a first means operative estimate a first intensity of impact of said hammer assembly on the associated string and a first timing for said impact from each key motion, a second means operative to estimate a second intensity of impact of said hammer assembly on said associated string and a second timing for said impact from each hammer motion, a third means for analyzing each of said fingerings on said plurality of keys, and a fourth means for selecting one of said first intensity of impact and said second intensity of impact and one of said first timing and said second timing for generating an electric signal.

2. The keyboard musical instrument as set forth in claim 1, in which each of said key sensors includes a shutter plate having a slit and a plurality of photo-sensors having respective light beams on a trajectory of said shutter plate.

3. The keyboard musical instrument as set forth in claim 1, in which each of said hammer sensors includes a shutter plate having a slit and at least one photo-sensor bridging a light beam across a trajectory of said shutter plate.

4. The keyboard musical instrument as set forth in claim 1, in which said fourth means selects said second intensity and said second timing in so far as said third means decides said fingering to be a simple motion from a rest position to an end position.

5. The keyboard musical instrument as set forth in claim 4, in which said third means decides said fingering to be said simple motion when said key motion starts after a predetermined lapse of time from the previous key motion.

6. The keyboard musical instrument as set forth in claim 1, in which said fourth means selects said first intensity and said first timing when said third means decides said fingering to be repeated before said key is recovered to a rest position.

7. The keyboard musical instrument as set forth in claim 1, said fourth means ignores both of said first intensity and said second intensity and both of said first timing and said second timing when said third means decides said second intensity and said second timing are estimated on the basis of a chattering of said hammer sensor.

8. A keyboard musical instrument having at least an acoustic sound mode and an electronic sound mode, comprising:

an acoustic piano including a plurality of keys responsive to fingerings of a player so as to turn around a stationary board member, a plurality of key action mechanisms functionally connected to said plurality of keys, and a plurality of strings corresponding to said plurality of keys, respectively, a plurality of hammer assemblies respectively driven for rotations by said plurality of key action mechanisms, and respectively striking said plurality of strings through said rotations for generating acoustic sounds;

an electronic system including a plurality of key sensors respectively associated with said plurality of keys for monitoring key motions, and producing key position signals each indicative of an actual key position of the associated key, a plurality of hammer sensors respectively associated with said plurality of hammer assembly for monitoring hammer motions, and producing hammer position signals each indicative of an actual hammer position of the associated hammer assembly, a first means operative estimate a first intensity of impact of said hammer assembly on the associated string and a first timing for said impact from each key motion, a second means operative to estimate a second intensity of impact of said hammer assembly on said associated string and a second timing for said impact from each hammer motion, a third means for analyzing each of said fingerings on said plurality of keys, and a fourth means for selecting one of said first intensity of impact and said second intensity of impact and one of said first timing and said second timing for generating electronic sounds; and a silent system changed between a free position in said acoustic sound mode and a blocking position in said electronic sound mode, said silent system in said free position allowing said plurality of hammer assemblies to strike the associated strings for playing a music through said acoustic sounds, said silent system in said blocking position causing said plurality of hammer assembly to rebound before an impact on said strings, thereby allowing said electric system to play a music through said electronic sounds.

* * * * *